United States Patent [19]

Fresard

[11] 4,108,092

[45] Aug. 22, 1978

[54] ZIG-ZAG SEWING MACHINE

[75] Inventor: Marcel Fresard, Petit-Lancy, Switzerland

[73] Assignee: Mefina S.A., Fribourg, Switzerland

[21] Appl. No.: 750,123

[22] Filed: Dec. 13, 1976

[30] Foreign Application Priority Data

Dec. 18, 1975 [CH] Switzerland ..... 16449/75

[51] Int. Cl.[2] ..... D05B 3/02

[52] U.S. Cl. ..... 112/158 R; 112/221

[58] Field of Search ..... 112/158 R, 158 A–158 F, 112/159, 65, 221, 235, 236, 237, 238, 239

[56] References Cited

U.S. PATENT DOCUMENTS

| | | | |
|---|---|---|---|
| 1,379,468 | 5/1921 | Matson | 112/221 |
| 1,595,245 | 8/1926 | Rader | 112/158 R |
| 2,280,289 | 4/1942 | Gerber | 112/158 R |
| 2,853,964 | 9/1958 | Zylbert | 112/158 R |
| 2,856,874 | 10/1958 | Odermann | 112/158 R |

FOREIGN PATENT DOCUMENTS

| | | | |
|---|---|---|---|
| 1,410,544 | 8/1968 | Fed. Rep. of Germany | 112/158 R |
| 458,899 | 8/1968 | Switzerland | 112/221 |

*Primary Examiner*—Werner H. Schroeder
*Attorney, Agent, or Firm*—Emory L. Groff, Jr.

[57] ABSTRACT

A pre-assembled sub-assembly of a plate carrying a needle bar on an oscillable cradle is mounted in a head at the free end of the upper arm of a zig-zag sewing machine. The upper edge of the plate is pivotally suspended from and slidable along a transverse bar. The plate is angularly fixed with the bore of a member on the needle bar in alignment with and receiving a gudgeon of a crank rod driven by the principal shaft of the machine, and is fixed on the bar to align the needle bar for cooperation of the needle with a shuttle hook.

3 Claims, 2 Drawing Figures

ZIG-ZAG SEWING MACHINE

Figure 2:
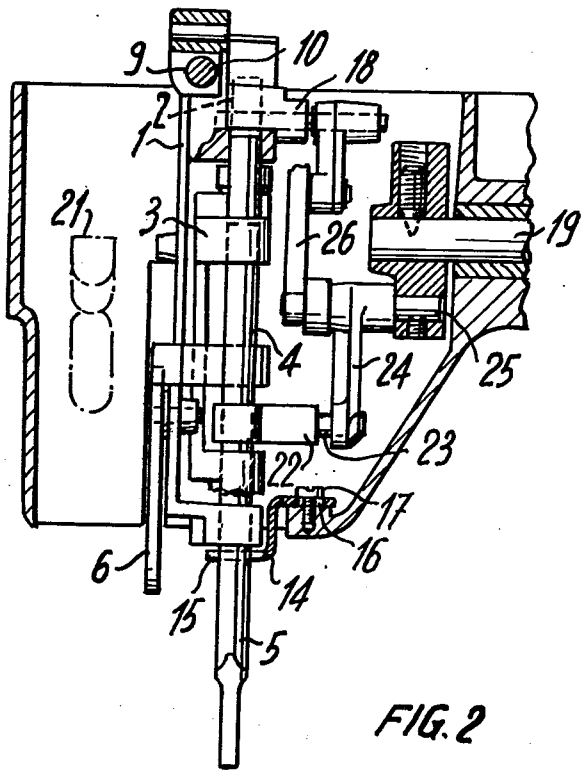

The invention relates to zig-zag sewing machines of the type including an upper arm in which is housed a principal driving shaft having at its free end a crank driving a needle bar slidably mounted in a cradle pivoted on a shaft fixed on a plate, disposed transverse to the upper arm, in a head formed at the free end of the upper arm.

French Patent Specification No. 1,121,708 describes a sewing machine in which the needle-bar and cloth-pressing foot are mounted on a plate screwed onto the frame of the machine. This pre-assembly of various mobile parts of the machine on a plate facilitates their assembly, but increases the difficulties of adjusting the members coupling these mobile parts to their driving members.

To avoid this drawback, a zig-zag sewing machine according to the invention is characterized in that it comprises a cylindrical bar mounted transversally in the machine head at right angles to the principal shaft and from which plate is pivotally suspended by its upper edge, the plate having adjacent its lower edge a piece for adjustably securing the plate to the machine head in a position in which the bore of a member, fixed on the needle bar, is in alignment with and receives a gudgeon carried by a crank-rod of the crank driving the needle-bar.

Figure 1:
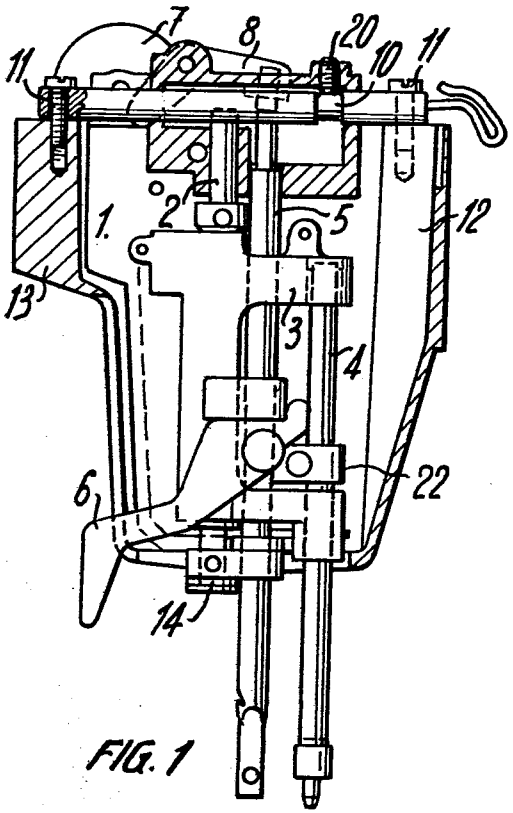

The accompanying drawings show, schematically and by way of example, an embodiment of the sewing machine according to the invention. In the drawings:

FIG. 1 is a partial elevational view, in transverse cross-section, of the head of the sewing machine; and FIG. 2 is a longitudinal cross-section of the head of the sewing machine.

The sewing machine shown includes a pre-assembled sub-assembly comprising a plate 1 to which is fixed the oscillation shaft 2 of a cradle 3 in which a needle-bar 4 is slidably mounted. A cloth-pressing bar 5 as well as its control lever 6 are also mounted on the plate 1 which also carries, adjacent its upper edge, a rotatable knob 7 associated with a lever 8 for regulating the pressure exerted by the cloth-pressing bar 5, and the point of attachment 18 of a thread-pulling rod 26.

The plate 1 has along its upper edge a bore 9 engaged on a cylindrical bar 10 provided at its ends with screws 11 by which it is fixed to the front and rear side walls 12, 13 of the head of the sewing machine. It is thus possible to move the plate 1 in the plane of FIG. 1, i.e. transverse to the head of the machine, to position a needle fixed to the lower end of the needle-bar 4 in relation to a rotary or oscillating shuttle hook (not shown) which is lodged in the lower part of the frame of the machine.

By then pivoting the plate 1 about the cylindrical bar 10 in the plane of FIG. 2, the bore of a member 22 fixed on the needle-bar 4 is aligned to receive a gudgeon 23 carried by a connecting rod 24 of a crank 25 driving the needle-bar 4. The plate 1 is held in this position by a bracket or securing means 14 having at one of its ends a bore 15 engaging the lower end of the oscillation shaft 2 of the cradle 3. At its other end, the bracket 14 has an oblong hole 16 in which is engaged a screw 17 which fixes the bracket 14, in the selected position, to the head of the machine.

In addition to tightening the screw 17 after the two positioning operations, one tightens a grub screw 20 (mounted in the part of the plate 1 having the bore 9) onto the cylindrical bar 10, to lock the plate 1 and all of the pieces it carries in the operational position on the sewing machine.

Of course, before carrying out these positioning and locking operations of the plate 1, the movable pieces it carries, notably the piece 22 of the needle-bar 4 and the thread-pulling rod 26, are connected to the principal shaft 19 of the machine. Likewise, the cradle 3 is connected, in known manner, to the members (not shown) of the machine controlling its oscillations during sewing zig-zag stitches.

Numerous variations of the assembly of pieces on the plate 1 can be envisaged. One may for example also fix on the plate 1 the socket 21 of a lamp lodged in the head of the machine to illuminate the working surface of the lower part of the frame of the machine.

The pre-assembled sub-assembly of pieces on a plate mounted in the head of the sewing machine enables these pieces to be precisely positioned relative to one another while simplifying their assembly. The possibilities of adjusting the position of the plate inside the head of the machine enable alignment of the coupling members of the pieces pre-assembled on the plate with their driving members; this is notably the case of the bore of the piece 22 fixed on the needle-bar 4 which may thus be very precisely aligned with the gudgeon 23 which drives it, and the thread-pulling control mechanism. It is thus possible to increase the manufacturing tolerances of parallelism and perpendicularity of the pieces forming part of these various mechanisms and, consequently, to lower the cost price of the machine.

Also, the upper arm of the machine may be made in one piece with the head and column of the machine. It is thus no longer necessary to fit the front half of the head of the machine onto the half of the head adjacent the arm, beyond a transverse partition supporting said pieces.

I claim:

1. In a zig-zag sewing machine including, an upper arm having a head at its free end, a principal driving shaft disposed in said upper arm having a free end in said head, a plate disposed in said head transversely to said upper arm, a cradle having a shaft connected to said plate, a needle bar slidably mounted in said cradle, the improvement comprising, a cylindrical bar mounted transversely in said head at right angles to said principal shaft, said plate pivotally suspended by its upper edge from said cylindrical bar, a member fixedly attached to said needle bar and having a bore, a crank connecting rod having a gudgeon engageable within said member bore, and securing means cooperating with and disposed adjacent the lower portion of said plate and adjustably securable to said head to maintain alignment between said member bore and gudgeon by manipulation of said securing means to alter the disposition of said plate about said cylindrical bar.

2. A sewing machine according to claim 1 wherein, said plate is movably mounted along said bar in a direction transverse to said head, and lockable means for fixably securing said plate on said bar to maintain said needle bar in a selected alignment.

3. A sewing machine according to claim 1 wherein, said securing means comprises a bracket having a bore engaging the lower end of said shaft of said cradle, said bracket having an oblong hole engaging said head and a screw passing through said oblong hole to provide adjustability in positioning between said bracket and head.

* * * * *